US010030573B2

(12) United States Patent
Cha et al.

(10) Patent No.: US 10,030,573 B2
(45) Date of Patent: Jul. 24, 2018

(54) ADAPTER FOR ENGINE COOLING SYSTEM

(71) Applicant: Hyundai Motor Company, Seoul (KR)

(72) Inventors: Yong Woong Cha, Gyeonggi-do (KR); Soo Yong Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/955,880

(22) Filed: Dec. 1, 2015

(65) Prior Publication Data

US 2017/0067389 A1 Mar. 9, 2017

(30) Foreign Application Priority Data

Sep. 7, 2015 (KR) ..... 10-2015-0126538

(51) Int. Cl.
*F01P 11/04* (2006.01)
*F01P 3/20* (2006.01)
*F01P 11/02* (2006.01)

(52) U.S. Cl.
CPC ..... *F01P 11/04* (2013.01); *F01P 3/20* (2013.01); *F01P 11/028* (2013.01); *F01P 11/029* (2013.01); *F01P 2060/12* (2013.01); *F01P 2060/18* (2013.01)

(58) Field of Classification Search
CPC .... F01P 11/029; F01P 11/028; F01P 2060/08; F01P 2007/146
See application file for complete search history.

(56) References Cited

U.S. PATENT DOCUMENTS 4,463,802 A * 8/1984 Villeval ..... F01P 11/02 123/41.54
5,662,072 A * 9/1997 Suzuki ..... F01P 11/029 123/142.5 R
7,984,699 B2 * 7/2011 Theorell ..... F01P 11/028 123/41.01
8,047,450 B2 * 11/2011 Hutchins ..... F01P 7/16 123/41.05
8,820,272 B2 * 9/2014 Terry ..... F01P 11/20 123/41.14
2006/0162676 A1 * 7/2006 Pegg ..... F01P 7/164 123/41.1
2009/0277401 A1 * 11/2009 Theorell ..... F01P 11/028 123/41.1
2011/0061613 A1 * 3/2011 Hutchins ..... B01D 19/0036 123/41.01

FOREIGN PATENT DOCUMENTS

JP 05-280712 A 10/1993
JP 2005-214007 A 8/2005
JP 2009-544885 A 12/2009
KR 20-1987-0004009 A 3/1987

* cited by examiner

*Primary Examiner* — Long T Tran
(74) *Attorney, Agent, or Firm* — Mintz Levin Cohn Ferris Glovsky and Popeo, P.C.; Peter F. Corless

(57) ABSTRACT

An adapter for an engine cooling system is provided. The adapter, includes a main pipe, having a first end coupled to a first degassing line connected to a high-temperature component, and a second end of coupled to a second degassing line connected to a reservoir tank. A branch pipe is branched from one side of the main pipe to be coupled to a third degassing line connected to the low-temperature component. An inner pipe is disposed at an interior circumference of the main pipe and has a diameter that is gradually reduced toward the reservoir tank.

9 Claims, 3 Drawing Sheets

ADAPTER FOR ENGINE COOLING SYSTEM

CROSS-REFERENCE TO RELATED APPLICATION

This application claims priority to and the benefit of Korean Patent Application No. 10-2015-0126538 filed in the Korean Intellectual Property Office on Sep. 7, 2015, the entire contents of which are incorporated herein by reference.

BACKGROUND (a) Field of the Invention

The present invention relates to an adapter for an engine cooling system and more particularly, to an adapter for an engine cooling system coolant that improves cooling performance by increasing coolant flow.

(b) Description of the Related Art

Generally, when driving a vehicle, an explosion temperature inside an engine combustion chamber reaches a high-temperature of about 1500° C. When a high-temperature is not properly decreased, an engine overheats, and the engine and various components are damaged. For example the viscosity of a lubricant decreases, and abnormal combustion occurs, and as a result, the engine may become inoperative. Accordingly, an engine cooling system for cooling the engine has been developed, and the system supplies a coolant into a coolant chamber provided at a cylinder block and a cylinder head to decrease temperature of an area proximate to a combustion chamber and to properly maintain temperature to provide stable operation of a piston and various valves.

In particular, a water-cooled engine cooling system, which pushes a coolant, includes a radiator connected to the engine via a coolant line, a reservoir tank, a pressure cap installed at the reservoir tank, etc. Further, the water-cooled engine cooling system includes a degassing line connected to the radiator and the engine (e.g., a turbocharger) for discharging air bubbles that occur when the coolant circulates to the exterior. However, a reservoir tank and a degassing line of a conventional engine cooling system are typically made of expensive materials with a highly heat-resistant property. Accordingly, the reservoir tank and the degassing line may not deformed due to excessive heat of the vapor when vapor flows within the reservoir tank.

The above information disclosed in this section is merely to enhance the understanding of the background of the invention and therefore it may contain information that does not form the prior art that is already known in this country to a person of ordinary skill in the art.

SUMMARY

The present invention provides an adapter for an engine cooling system that reduces heat damage applied to a degassing line by rapidly eliminating vapor in an engine.

In one aspect, an exemplary embodiment provides an adapter for an engine cooling system that may include a main pipe, a first end coupled to a first degassing line connected to a high-temperature component and a second end coupled to a second degassing line connected to a reservoir tank. A branch pipe may be branched from one side of the main pipe coupled to a third degassing line connected to the low-temperature component and an inner pipe may be disposed at an interior circumference of the main pipe and may have gradual reduction in diameter toward the reservoir tank.

The inner pipe may include an inlet into which a coolant discharged from the high-temperature component flows. The inner pipe may be coupled to the interior circumference of the main pipe and may include an outlet from which a coolant discharged from the high-temperature component is discharged. The diameter of the inner pipe may be gradually reduced from the inlet toward the outlet. The branch pipe may be coupled to the main pipe to be oblique with respect to a length direction of the main pipe and may allow the coolant discharged from the low-temperature component to merge inside the main pipe in an oblique direction.

A cavity may be formed between an exterior circumference of the inner pipe and the interior circumference of the main pipe. The cavity may derive a vortex of a coolant that flows in through the branch pipe. A central axis of the branch pipe may be offset by a predetermined distance from a central axis of the main pipe. The high-temperature component may include the engine or a turbocharger. The low-temperature component may include at least one of a radiator, a heater, and a water temperature controller (WTC).

BRIEF DESCRIPTION OF THE DRAWINGS

The above and other objects, features and other advantages of the present invention will be more clearly understood from the following detailed description when taken in conjunction with the accompanying drawings.

DESCRIPTION OF SYMBOLS

Figure 1:
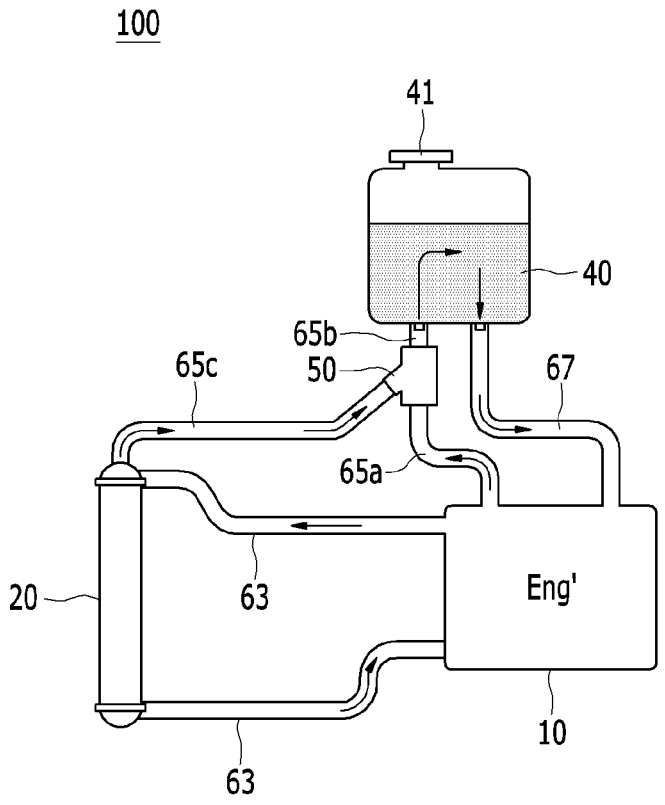
FIG. 1 illustrates an exemplary schematic diagram of an engine cooling system having an adapter according to an exemplary embodiment of the present invention.

100: engine cooling system
10: engine
20: radiator
40: reservoir tank
41: pressure cap
50: adapter
51: main pipe
53: branch pipe
55: inner pipe
55*a*: inlet
55*b*: outlet
59: cavity
63: coolant circulation line
65*a*: first degassing line
65*b*: second degassing line
65*c*: third degassing line
67: coolant supply line

DETAILED DESCRIPTION

Hereinafter, exemplary embodiments of the present invention will be described with reference to the accompanying drawings. In the following detailed description, only certain exemplary embodiments of the present invention have been shown and described, simply by way of illustration. As those skilled in the art would realize, the described embodiments may be modified in various different ways, all without departing from the spirit or scope of the present invention.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 2:
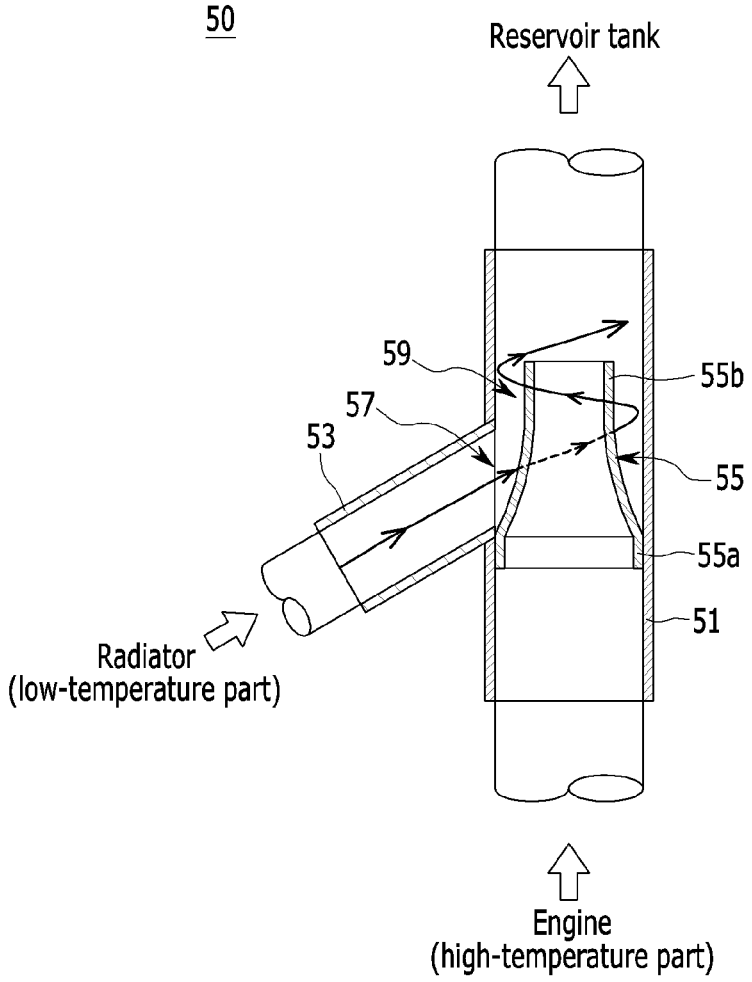
FIG. 2 illustrates an exemplary longitudinal cross-sectional view of an adapter according to an exemplary embodiment of the present invention.
Figure 3:
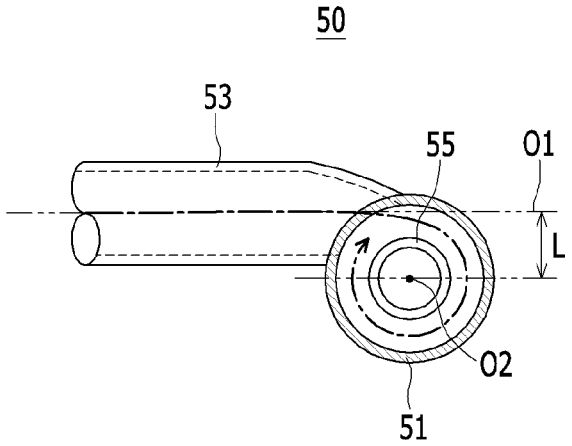
FIG. 3 illustrates an exemplary transverse cross-sectional view of an adapter according to an exemplary embodiment of the present invention.

FIG. 1 illustrates an exemplary schematic diagram of an engine cooling system having an adapter according to an exemplary embodiment of the present invention. FIG. 2 illustrates an exemplary longitudinal cross-sectional view of an adapter according to an exemplary embodiment of the present invention. FIG. 3 illustrates an exemplary transverse cross-sectional view of an adapter according to an exemplary embodiment of the present invention. As shown in FIG. 1, an engine cooling system 100 having an adapter 50 according to an exemplary embodiment of the present invention may include a high-temperature component, a low-temperature component, a reservoir tank 40, and a plurality of degassing lines.

The high-temperature component may include an engine, a turbocharger, etc., and an engine 10 may be exemplified and described as the high-temperature component in an exemplary embodiment. The low-temperature component, that supplies a low-temperature coolant to the high-temperature component, may include a radiator, a heater, a water temperature controller (WTC), etc., and a radiator 20 will be exemplified and described as the low-temperature component in the exemplary embodiment. The radiator 20 may be configured to dissipate heat of the coolant into the air, and may be connected (e.g., in fluid communication with) to the engine 10 through a coolant circulation line 63 to supply and collect the coolant. For example, the radiator 20 may be configured to supply the coolant for cooling the engine 10 to the engine 10 through the coolant circulation line 63, and collect the coolant discharged from the engine 10.

The reservoir tank 40 may include a pressure cap 41. For example, when a coolant pressure within the reservoir tank 40 is high, (e.g., greater than a predetermined pressure) the pressure cap 41 may discharge air bubbles that may occur while the coolant circulates in the engine 10. Further, when the coolant is insufficient, the reservoir tank 40 connected to the engine 10 through a coolant supply line 67 may supplement the coolant. The reservoir tank 40, when the engine 10 is operated, may collect and remove bubbles included in a high-temperature coolant discharged from the engine 10 through degassing lines (65*a*, 65*b*, and 65*c*).

The first degassing line 65*a* may be applied as a line that removes the bubbles included in the coolant discharged from the engine 10, and may be coupled to the second degassing line 65*b* and may further be connected to the reservoir tank 40 through the adapter 50. The third degassing line 65*c* may be applied as a line that removes the bubbles included in the coolant discharged from the radiator 20. The third degassing line 65*c* may also be coupled to the second degassing line 65*b* through the adapter 50. The coolant circulation line 63 and the degassing lines (65*a*, 65*b*, and 65*c*) may be a form of a tube or a hose made of a rubber material.

As shown in FIGS. 2 and 3, the adapter 50 according to an exemplary embodiment of may include a main pipe 51, a branch pipe 53, and an inner pipe 55. The adapter 50 may couple the first degassing line 65*a* to the second degassing line 65*b*, and may be branched from one side thereof to couple the third degassing line 65*c* to the second degassing line 65*b*. The adapter 50 may couple the first and third degassing lines (65*a* and 65*c*) to the second degassing line 65*b* and may be configured to increase the flow rate of the coolant.

Furthermore, the main pipe 51 and the branch pipe 53 of the adapter 50 may be formed having a hollow cylindrical shape. The main pipe 51 and the branch pipe 53 may be integrally formed, or may be formed by bonding the branch pipe 53 to an aperture of the main pipe 51 after forming the aperture in one side of the main pipe 51. The branch pipe 53 may be connected to the main pipe 51 to be oblique with respect to a length direction of the main pipe and may allow the coolant discharged from the radiator 20 to merge within the main pipe 51 in an oblique direction. A central axis O1 of the branch pipe 53 may be offset by a predetermined distance from a central axis O2 of the main pipe 51. For example, the central axis O1 of the branch pipe 53 does not contact the central axis O2 of the main pipe 51.

The inner pipe 55 may be disposed at a branch point 57 to which the branch pipe 53 is connected within the main pipe 51. The inner pipe 55 may be disposed at an interior circumference of the main pipe 51, and may be formed in a hollow cylindrical shape having a gradually reduction in diameter toward the reservoir tank 40. The inner pipe 55 may include an inlet 55*a* into which the coolant may flow and an outlet 55*b* from which the coolant may be discharged. The inlet 55*a* may have a diameter that may be constantly extendedly formed, and may be coupled (e.g., fixed) to the interior circumference of the main pipe 51. A diameter of the outlet 55*b* may be gradually reduced from the inlet 55*a* toward the outlet 55*b*.

Accordingly, the inner pipe 55 may be disposed at the branch point 57 of the main pipe 51 to guide and adjust the flow rate of the coolant from the engine 10 to the reservoir tank 40. The inner pipe 55 may be (e.g., forcibly) inserted into the interior of the main pipe 51, and may be fixed thereto to provide stability when exposed to the coolant flow or an external impact. Since the inner pipe 55 has the diameter gradually reduced from the inlet 55*a* toward the outlet 55*b*, a cavity 59 may be formed between an exterior circumference of the inner pipe 55 and the interior circumference of the main pipe 51. For example, the cavity 59 may be formed between the exterior circumference of the inner pipe 55 and the interior circumference of the main pipe 51 except at the inlet 55*a*.

In particular, the central axis O1 of the branch pipe 53 may be offset by the predetermined distance L from the central axis O2 of the main pipe 51. The cavity 59 may provide an outer passage that may derive a vortex of the coolant that flows in through the branch pipe 53. A first end of the main pipe 51 may be connected to the first degassing line 65*a*, and a second end thereof may be connected to the second degassing line 65*b*. The branch pipe 53 may be branched from one side of the main pipe 51, and may be connected to the third degassing line 65*c*.

According to the adapter 50 of the exemplary embodiment of the present invention, the coolant discharged from the engine 10 may flow in the inner pipe 55. The coolant discharged from the radiator 20 may eccentrically obliquely flow in the cavity 59 through the branch pipe 53. Accordingly, the flow rate of the coolant within the inner pipe 55 may increase, and the coolant may flow within the cavity 59 and cause a vortex. The circulation resistance between the coolant discharged from the engine 10 and the coolant discharged from the radiator 20 may be reduced (e.g., minimized), and may rapidly increase the flow rate of the coolant supplied to the reservoir tank 40.

Therefore, the adapter 50 for an engine cooling system according to the exemplary embodiment of the present invention may be configured eliminate the vapor in the engine 10, since the diameter of the inner pipe 55 may be gradually reduced from the engine 10 toward the reservoir tank 40 to rapidly increase the flow rate of the coolant flowing in from the engine 10. Additionally, the adapter 50 and the second degassing line 65*b* may be prevented from being damaged by the high-temperature, by cooling the high-temperature coolant that flows in the inner pipe 55 by the low-temperature coolant that flows in the cavity 59. Further, the circulation resistance between the coolant that flows in from the engine 10 and the coolant that flows in from the radiator 20 may be improved by generation of a vortex in the flow of the coolant discharged from the radiator 20 through the cavity 59.

When an ignition switch of the vehicle is disengaged (e.g., turned off), the adapter 50 for an engine cooling system 50 may be configured to derive a flow of the coolant by the vapor. In other words, when the ignition switch of the vehicle is disengaged, the coolant may be expanded in a vapor state within the high-temperature component. For example, as the engine 10 or the turbocharger initiates the flow in the reservoir tank 40, the coolant in the radiator 20 flows within the reservoir tank 40 by a negative pressure. Accordingly, the coolant of the reservoir tank 40 may be supplied through the supply line 67 to supplement the coolant discharged from the radiator 20. Further, the vapor of the high-temperature component and the coolant of the low-temperature component may be mixed within the interior of the reservoir tank 40 to be in a liquefied state, a vapor leak through the pressure cap 41 may be minimized Additionally, various hoses may be prevented from being damaged by heat, and an electrical water pump may be eliminated, thereby reducing costs of the system.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. An adapter for an engine cooling system, comprising:

a main pipe having a first end coupled to a first degassing line connected to a high-temperature component to receive a coolant from the high-temperature component, and a second end coupled to a second degassing line connected to a reservoir tank;

a branch pipe that is branched from one side of the main pipe to be coupled to a third degassing line connected to a low-temperature component to receive a coolant from the low-temperature component; and an inner pipe disposed at an interior circumference of the main pipe and has a diameter that is gradually reduced toward the reservoir tank, wherein the inner pipe includes:

an inlet into which the coolant from the high-temperature component flows and is fitted onto the interior circumference of the main pipe, and an outlet from which the coolant flowing through the inlet is discharged, wherein the diameter of the inner pipe is gradually reduced from a position corresponding to a branch point of the branch pipe from the main pipe toward the outlet, wherein the coolant from the low-temperature component flows along an exterior circumference of the inner pipe so as to cool the coolant from the high-temperature component in the main pipe, and wherein both the coolant flowing through the branch pipe and the coolant flowing through the outlet are arranged to flow continuously to the reservoir tank through the second end of the main pipe.

2. The adapter for an engine cooling system of claim 1, wherein the branch pipe is coupled to the main pipe to be oblique with respect to a length direction of the main pipe and the coolant discharged from the low-temperature component merges inside the main pipe in an oblique direction.

3. The adapter for an engine cooling system of claim 1, wherein a cavity formed between an exterior circumference of the inner pipe and the interior circumference of the main pipe, wherein the cavity derives a vortex of a coolant flowing in through the branch pipe.

4. The adapter for an engine cooling system of claim 3, wherein a central axis of the branch pipe is offset by a predetermined distance from a central axis of the main pipe.

5. The adapter for an engine cooling system of claim 1, wherein the high-temperature component includes the engine or a turbocharger.

6. The adapter for an engine cooling system of claim 1, wherein the low-temperature component includes at least one of a radiator, a heater, and a water temperature controller (WTC).

7. The adapter for an engine cooling system of claim 1, wherein the reservoir tank includes a pressure cap.

8. The adapter for an engine cooling system of claim 1, wherein the reservoir tank is connected to the engine through a coolant supply line to supplement the coolant supply.

9. The adapter for an engine cooling system of claim 1, wherein the inner pipe is disposed at the branch point to which the branch pipe is connected within the main pipe.

* * * * *